US007811616B2

(12) United States Patent
Schönemann et al.

(10) Patent No.: US 7,811,616 B2
(45) Date of Patent: Oct. 12, 2010

(54) METHOD AND DEVICE FOR CONTROLLING COOKING PROCESSES IN A COOKING CHAMBER

(75) Inventors: Konrad Schönemann, Sulzfeld (DE); Michael Riffel, Oberderdingen (DE); Lutz Ose, Sternenfels (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 576 days.

(21) Appl. No.: 11/850,872

(22) Filed: Sep. 6, 2007

(65) Prior Publication Data

US 2008/0008808 A1 Jan. 10, 2008

Related U.S. Application Data

(63) Continuation of application No. PCT/EP2006/001729, filed on Feb. 24, 2006.

(30) Foreign Application Priority Data

Mar. 7, 2005 (DE) ..... 10 2005 011 305

(51) Int. Cl.
*A23L 1/01* (2006.01)

(52) U.S. Cl. ..... 426/233; 426/523; 99/332; 219/707; 219/492

(58) Field of Classification Search ..... 426/231, 426/233, 523, 466; 99/325, 331–333; 219/707, 219/710, 490, 492
See application file for complete search history.

(56) References Cited

U.S. PATENT DOCUMENTS 4,311,895 A 1/1982 Tanabe
4,335,293 A 6/1982 Kobayashi et al.
4,484,065 A * 11/1984 Ueda ..... 219/492
4,507,529 A * 3/1985 Smith et al. ..... 219/707
4,814,570 A * 3/1989 Takizaki ..... 219/705
5,349,163 A 9/1994 An
5,369,253 A * 11/1994 Kuwata et al. ..... 219/707
5,545,881 A * 8/1996 Chai et al. ..... 219/719
5,681,496 A 10/1997 Brownlow et al.
7,075,041 B2 7/2006 Kruempelmann et al.
2005/0061799 A1 3/2005 Kruempelmann et al.
2009/0274805 A1 * 11/2009 Schonemann ..... 426/233

FOREIGN PATENT DOCUMENTS

AU 2005202001 A1 11/2005

(Continued)

*Primary Examiner*—Drew E Becker
(74) *Attorney, Agent, or Firm*—Alston & Bird LLP

(57) ABSTRACT

A control method for an oven comprises the steps of determination of the food product, reading out of a corresponding vector from a memory, whereby the vector is at least two-dimensional and previously empirically determined, with a time value and a scalar value, recording the concentration of a gas characteristic of the cooking product by means of a gas sensor, recording a first point, at which the time curve for the gas concentration has the absolute greatest gradient, storage of the same and the corresponding time, recording a second point, at which the time curve of the gas concentration has a zero gradient and storing the corresponding time, determination of the gradient of the straight line through the first and second points, calculation of the cooking duration by multiplication of the straight line gradient by the scalar value and addition of the time value of the vector.

10 Claims, 1 Drawing Sheet

FOREIGN PATENT DOCUMENTS

| | | | |
|---|---|---|---|
| DE | 10230242 | A1 | 1/2004 |
| DE | 10307247 | | 8/2004 |
| DE | 10327864 | | 1/2005 |
| DE | 10340146 | | 3/2005 |
| EP | 1253382 | | 10/2002 |

* cited by examiner

METHOD AND DEVICE FOR CONTROLLING COOKING PROCESSES IN A COOKING CHAMBER

RELATED APPLICATIONS

This application is a continuation of PCT/EP2006/001729, filed Feb. 24, 2006, which in turn claims priority to DE 102005011305.2, filed on Mar. 7, 2005, the contents of both of which are incorporated by reference.

FIELD OF APPLICATION

The invention relates to a method for controlling cooking processes in a cooking chamber and a device for the same.

BACKGROUND

It is known from U.S. Pat. No. 7,075,041 B1, for example, to control a cooking process in a cooking appliance in a contactless manner. A cooking product is either manually selected or automatically detected. A gas sensor measures the gas concentration in a cooking chamber, for example an oven, and a cooking quotient is determined in its time behaviour. By comparing the cooking quotient with a final value of the gas concentration, it is possible to control and, in particular, end the cooking process if, on the basis of theoretical set points in conjunction with the measured gas concentration, the cooking product is ready.

The problem addressed by the invention is to provide an alternative method and device for controlling and extensively automating a cooking process in a cooking chamber or cooking appliance and advantageously detection takes place very easily, precisely and faultlessly.

BRIEF DESCRIPTION OF THE DRAWINGS

An embodiment of the invention is diagrammatically represented in the drawings and explained in greater detail hereinafter wherein.

DETAILED DESCRIPTION OF THE DRAWINGS

Figure 1:
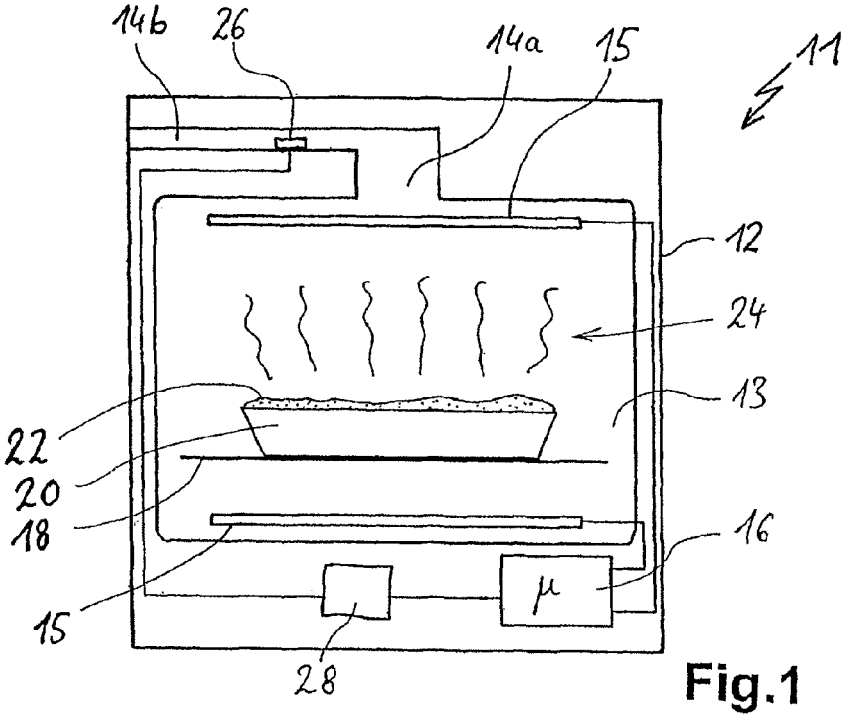
FIG. 1 illustrates a diagrammatic representation of one embodiment of an inventive oven with gas sensor and control.

This problem is solved in one embodiment by a method and a device having the features as claimed herein. Advantageous and preferred developments of the invention form the subject matter of the further claims and are explained in greater detail hereinafter, the method and the associated device being in part explained jointly. By express reference the wording of the claims is made into part of the content of the description.

For the method, the cooking product to be cooked is determined and this can take place in different ways, as will be explained in greater detail hereinafter. With said cooking product is linked a vector, which is read out of a memory of an evaluating or analytical circuit. This vector results from a plurality of vectors stored in the memory and which have previously been empirically determined for this method for a plurality of different cooking products and then stored in the memory, for example in the factory. The vector is at least two-dimensional and has at least one time value and at least one scalar value. The concentration of a gas characteristic for the determined cooking product is then measured by a gas sensor. Advantageously said gas sensor is specifically designed or configured for said characteristic gas, for example, in that it is differently controllable for particularly good detection of different gases. The time behaviour of the characteristic gas concentration is then measured. A first point is detected at which the concentration has the absolute greatest gradient. This extreme value of the time behaviour of the concentration can be either a maximum or a minimum. Both the value of said absolute greatest gradient and the time at which it is reached are stored. A second point is then detected at which the gas concentration has the zero gradient. Here, only the time of reaching said second point is stored.

Then, mathematically a straight line is placed through the first and second points and the gradient thereof is determined. By means of said gradient or straight line, it is possible to carry out the further calculation of the entire cooking period. This takes place in that the straight line gradient is multiplied by the scalar value of the read-out vector. Then the time value of the read-out vector is added thereto and in this way the total cooking period is determined. Compared with the cooking period which has already elapsed, it is possible to determine the residual cooking period. On reaching the same, the attention of an operator can be drawn to the end of cooking by corresponding signals and alternatively the cooking process can be stopped, particularly by switching off the heater in the cooking chamber.

In this way, a large number of different cooking products can be used for the at least partly automated method or can be cooked in this way. The empirical determination of the different vectors for different cooking products admittedly involves a certain expenditure. However, it is possible for the determination to take place in the factory with storage in the memory and this represents an acceptable cost in the case of numerous identical cooking appliances. The detection of the first and second points is relatively simple, as both points are very characteristic. The two-dimensional vector permits a relatively simple calculation. Through the binding in of these two points and their corresponding time points it is possible to cook in a largely automated manner different cooking products with variations with respect to the recipe and cooking type. Account can also be taken of variations compared with nominal set points.

Another advantage of using the gas concentration gradient is that in this way it is possible to largely avoid or eliminate the ageing phenomena of a gas sensor, as well as an offset caused by ambient conditions during the operation of the gas sensor. This permits a relatively precise determination of the points to be established.

A determination of the cooking product to be cooked can take place in two different ways. It is firstly possible for an operator to manually input the cooking product or otherwise make it known in some manner to the analytical circuit. To accomplish this, there is a menu guide with corresponding input means.

Secondly, it is possible to analyze and determine the cooking product gases which have occurred from the outset using a gas sensor. This can bring about a detection of the cooking product in the cooking chamber, as is for example described in DE 103 401 46 A1. It is possible to start with a generally valid heating method, for example, to obtain a target temperature of 180° C. or 200° C. By means of such a generally valid or standardized heating the cooking product can be detected or determined by a gas sensor. Such a largely automated cooking product detection naturally has the major advantage of greater comfort for an operator. However, under certain circumstances the constructional costs or the analytical method costs are higher. Another possibility for the automatic detection or determination of the cooking product present in the cooking chamber is given in German patent application DE 102005011304 A1, to which express reference is made.

Advantageously, the determination of the points, that is the first point and the second point, takes place algorithmically by forming the difference between values of the gradient of the time behaviour of the characteristic gas concentration. This can take place in discreet time intervals of fixed duration, for example a few seconds.

It is also advantageously possible not to evaluate the sensor signals from the outset, because in most cases, it is not expected that the cooking process will be ended soon and the processes so-to-speak have not yet assumed a steady state. In particular it is appropriate to wait until the cooking chamber temperature has roughly approached the final temperature, for example, at least 70% thereof. Advantageously, the sensor signals are only analyzed when the cooking chamber temperature has reached 90% of the final temperature or the selected cooking temperature.

The gas sensors can be constructed or specified in different ways. They can also be constructed in such a way that they only detect the concentration of triatomic or even higher atomic gases in the cooking chamber. This permits a preselection of the gases to be detected, which reduces costs and can increase the reliability of detection. It is also possible for the gas sensors to be insensitive to oxygen, nitrogen and/or carbon dioxide and not detect said gases. However, it is also possible in individual cases for one of these three gases to be determined, particularly carbon dioxide, as a function of the cooking product.

It is also possible to determine the humidity in the cooking chamber or the moisture content of the spent air or the air in the cooking chamber. A specifically designed moisture sensor can be used for this purpose. The value of said moisture can be used in an advantageous manner for automatic detection of the cooking product and also for determining the finite time instant of the cooking process.

Due to the fact that the gas concentration is only measured close to the final temperature of the cooking chamber, the control of a gas sensor can be simplified. A sensor heating and the temperature control necessary for this is no longer absolutely necessary. However, in an advantageous development of the invention, both can be implemented.

An arrangement of the gas sensor or sensors in an air outlet conduit of the gas chamber, particularly in the hot exhalation conduit of an oven, is looked upon as being particularly advantageous. Thus, the gases can be determined in a relatively concentrated and, at the same time, uniformly distributed manner in the outgoing air, said gases arising during the cooking process in the cooking chamber.

These and further features can be gathered from the claims, description and drawings and individual features, both singly or in the form of subcombinations, can be implemented in an embodiment of the invention and in other fields and can represent advantageous, independently protectable constructions for which protection is claimed here. The subdivision of the application into individual sections and the subheadings in no way restrict the general validity of the statements made thereunder.

FIG. 1 diagrammatically shows an oven 11 in which the muffle 13 is surrounded by a correspondingly insulated wall 12. The muffle 13 contains an oven heater 15 with heating from above and below and is connected to an oven control 16. A pastry mould 20 with a dough mixture 22 as the cooking product is placed on a support grating 18 in muffle 13. It can be seen that as a result of the heating by the oven heater 15 that a gas or a gaseous mixture 24 flows out of the dough mixture 22 and said gas 24 contains different components. By means of said components it is possible in certain circumstances at the very beginning of the cooking process to carry out an automatic identification of the cooking product or dough mixture 22. Through said gas 24, it is also possible to detect or calculate the total cooking period, as will be explained in greater detail hereinafter.

In the upper area of the muffle 13 is provided a diagrammatically represented hot exhalation outlet 14*a*, which passes into a hot exhalation conduit 14*b*. Said hot exhalation conduit 14*b* passes in known manner outside of the muffle 13 or oven 11. A gas sensor 26 is located in the hot exhalation conduit 14*b* and is connected to sensor electronics 28. It is obviously possible and in certain embodiments of the invention even advantageous to provide more than one gas sensor 26 or a plurality of such gas sensors.

Using said gas sensor 26 or several gas sensors it is possible to detect a characteristic gas present in the gaseous mixture 24. As stated hereinbefore, at this time the oven 11 or more specifically control 16 already knows what cooking product is involved, namely that it is the specific dough mixture 22.

As a function of said known dough mixture 22, whose associated data or parameters are filed in a memory of control 16, in the spent gas flowing out of oven 11 through hot exhalation conduit 14*b*, a specific gas or its concentration K is measured. This concentration K is diagrammatically represented over time "t" in FIG. 2. As can be seen, the concentration initially only rises slowly, then reaches a maximum and then falls away relatively steeply. This maximum forms the aforementioned extreme value. It could also be a minimum, so as to be usable as an extreme value for the analysis.

At gas concentration K, the gradient or the first derivative K' is determined. This is represented in broken line form in its time behaviour over time t.

Figure 2:
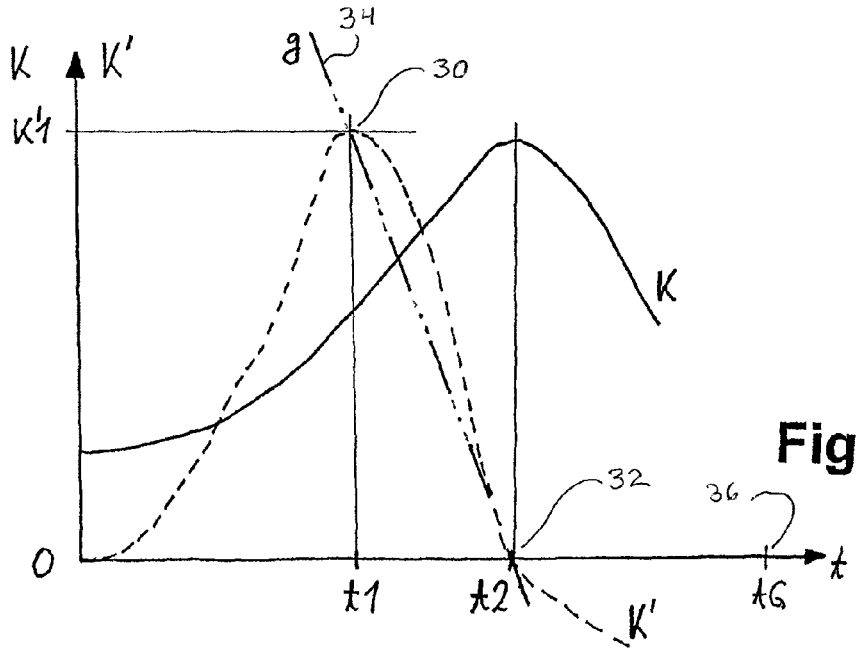
FIG. 2 illustrates a graph of the course of the gas concentration and its gradient.

For example, by forming the difference or similar mathematical methods the time point t1 is determined at which gradient K' has its highest value K'1 30 and this is shown in the graph of FIG. 2.

Determination also takes place as to when the gradient K' becomes zero 32 and said time point t2 is also indicated. A straight line "g", 34 represented in dot-dash line form, is then placed through the two previously determined points or purely mathematically the gradient of said line is determined. This gradient "m" is obtained through the equation:

$$m=K'1/(t2-t1)$$

With respect to the known cooking product or dough mixture 22 a corresponding, stored vector is now read out of the memory of control 16. This vector is two-dimensional and has a time value "t0" and a scalar value "S0". It can advantageously be empirically determined and for this type of oven 11 and specific cooking product groups, inter alia the dough mixture 22, can be determined in the factory and then read into control 16.

The entire cooking period tG 36 can now be calculated according to the equation $$tG=m*S0+t0$$

At the end of this total cooking period tG, the oven heater 15 is switched off by control 16. Alternatively, or additionally, a signal can be given to an operator, preferably acoustically and/or optically.

Thus, for the presently described, inventive method it is necessary for the type of cooking product to be known. This can be inputted into the oven 11 or control 16 by an operator using input means which are not shown in FIG. 1, but which can be easily implemented by one skilled in the art. Alternatively, for example, by means of gas sensor 26 and using gas 24 a detection of the cooking product or dough mixture 22 can take place, as described in the aforementioned German patent application DE 102005011304 A1. On the basis of this, the complete gaseous mixture is no longer investigated with respect to its individual gas components and instead attention is only paid to the concentration K of a characteristic gas 24, which is established by means of gas sensor 26.

The above-described, mathematical methods, particularly the calculation of the gradient K' of gas concentration K and also the determination of the maximum value K'1 of K', together with the associated time point t1 and the zero passage of K' at time point t2 are known and can be easily performed. Thus, by linking with a corresponding, known vector stored in the memory 16 and which in each case belongs to a specific cooking product, there can be an automatic calculation of the total cooking period tG for said cooking product 22. The cooking process can then be ended or the attention of an operator is drawn to this. Thus, this method is used for determining the finite time instant of the cooking process for a cooking product. The knowledge of the cooking product necessary for this can either be obtained by direct inputting by an operator or by automatic detection.

The invention claimed is:

1. A method for controlling a cooking process of a cooking product in a cooking chamber of an oven, comprising the following steps:

determining said cooking product to be cooked;

reading out from a memory of a control circuit a vector associated with said cooking product to be cooked, said vector being determined beforehand and having a time value and a scalar value;

detecting a concentration of a gas characteristic for said cooking product by means of a gas sensor;

detecting a first time at which a time behaviour of the concentration of said gas characteristic for said cooking product has a value of an absolute greatest gradient;

storing said value of said absolute greatest gradient and a time of reaching said first point;

detecting a second point at which said time behaviour of said concentration of said characteristic gas has a zero gradient;

storing said second time;

determining a gradient of a straight line through said first and second points; and calculating a total cooking period for said cooking product by multiplying said determined gradient of said straight line with said scalar value of said vector and adding said time value of said vector.

2. The method according to claim 1, wherein said cooking product is determined by manually presetting by an operator by manual inputting from a menu.

3. The method according to claim 1, wherein a detection of said cooking product takes place by analyzing said cooking product gases using at least one gas sensor, which arise upon heating the cooking product.

4. The method according to claim 1, wherein said first point and said second point are algorithmically determined by forming a difference using discreet time intervals.

5. The method according to claim 1, wherein signals from said gas sensor are only analyzed when said cooking chamber temperature, starting from an unheated cooking chamber state, has reached at least 70% of said final temperature.

6. The method according to claim 5, wherein signals from said gas sensor are only analyzed when said cooking chamber temperature, starting from an unheated state of said cooking chamber, has reached at least 90% of said final temperature.

7. The method according to claim 1, wherein a concentration of triatomic or higher atomic gases of said cooking product in said cooking chamber is detected by said gas sensor.

8. The method according to claim 1, wherein said detection of said gas is insensitive with respect to oxygen, nitrogen or carbon dioxide.

9. The method according to claim 1, wherein a humidity level in said cooking chamber is detected.

10. The method according to claim 1, wherein specific cooking product groups are defined and said specific cooking product groups in each case have a common main gas as main characteristic gas being produced during said cooking process.

* * * * *